US010378791B2

(12) United States Patent
Hinton et al.

(10) Patent No.: US 10,378,791 B2
(45) Date of Patent: Aug. 13, 2019

(54) ELECTRIC WATER HEATER HAVING INTEGRATED LOCK

(71) Applicant: RHEEM MANUFACTURING COMPANY, Atlanta, GA (US)

(72) Inventors: Arthur Y. Hinton, Pike Road, AL (US); Raheel A. Chaudhry, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 211 days.

(21) Appl. No.: 15/295,780

(22) Filed: Oct. 17, 2016

(65) Prior Publication Data

US 2018/0106501 A1 Apr. 19, 2018

(51) Int. Cl.

| | |
|---|---|
| ***H05B 1/02*** | (2006.01) |
| ***F24H 9/20*** | (2006.01) |
| ***F24H 1/20*** | (2006.01) |
| ***F24H 9/18*** | (2006.01) |

(52) U.S. Cl.

CPC ..... *F24H 9/2021* (2013.01); *F24H 1/202* (2013.01); *F24H 9/1818* (2013.01); *H05B 1/0283* (2013.01)

(58) Field of Classification Search

CPC ..... F24H 9/2021; F24H 1/202; F24H 9/1818; H05B 1/02; H05B 1/0283; H05B 1/0286; H05B 203/021

USPC ..... 219/494, 497, 507, 509; 392/447, 451, 392/454

See application file for complete search history.

(56) References Cited

U.S. PATENT DOCUMENTS

| | | | | |
|---|---|---|---|---|
| 4,347,575 | A * | 8/1982 | Gurr | H02J 13/0086 307/35 |
| 8,204,633 | B2 | 6/2012 | Harbin, III et al. | |
| 2005/0275536 | A1* | 12/2005 | Celi | E05B 73/00 340/542 |
| 2010/0179705 | A1* | 7/2010 | Flohr | F24H 9/2021 700/295 |
| 2011/0032072 | A1* | 2/2011 | Han | H04L 12/2827 340/5.1 |
| 2016/0163177 | A1* | 6/2016 | Klicpera | E03B 7/071 137/59 |

* cited by examiner

*Primary Examiner* — Mark H Paschall
(74) *Attorney, Agent, or Firm* — King & Spalding LLP

(57) ABSTRACT

A water heater has a tank and at least one heating element. A switch is disposed in an electric circuit between the heating element and a power source so that, if the switch is in a first state, the circuit is in an electrically conductive state and, if the switch is in a second state, the electric circuit is in an electrically non-conductive state. A controller is in operative communication with the switch and is responsive to a key so that actuation of the controller by the key transitions the switch between the first state and the second state.

15 Claims, 10 Drawing Sheets

ELECTRIC WATER HEATER HAVING INTEGRATED LOCK

FIELD OF THE INVENTION

The present invention relates generally to electric water heaters.

BACKGROUND OF THE INVENTION

Electric water heaters are used to heat and store a quantity of water in a storage tank for subsequent on-demand delivery to plumbing fixtures such as sinks, bathtubs, showers, and appliances in residential and commercial buildings. Electric water heaters typically utilize one or more electric resistance heating elements to supply heat to the tank-stored water under the control of a mechanical or electrical thermostat device that monitors the temperature of the stored water.

Storage-type electric water heaters typically include one or more heating elements to which electric current may be applied to thereby generate resistive heating. Both elements, assuming there are two, extend into the tank volume so that water within the tank receives heat directly from the elements. A control system controls the connection of electric current to the heating elements responsively to a comparison of water temperature to predetermined temperature set points. For example, the water heater may include a temperature sensor as a thermistor or bimetallic switch disposed on the outer surface of the water tank proximate a respective heating element so that the temperature sensor is responsive to temperature of water in the tank near the heating element. In the case of a bimetallic switch, the switch is configured to open at a predetermined high temperature (i.e. the high set point temperature) and close at a predetermined low temperature (i.e. the low set point temperature). In turn, the bimetallic switch controls the operation of a switch in the electric current path between line current and the heating element. Thus, if the bimetallic switch detects that water in the tank is at or below the lower set point, the bimetallic switch closes, thereby closing the switch in the electric current path and providing electric current to the heating element. This causes the heating element to generate resistive heat, thereby increasing temperature of water in the tank. The bimetallic switch continues to sense the tank water's temperature as that temperature increases. When the switch detects that the temperature has reached the high set point, the switch opens, thereby opening the circuit switch and disconnecting the electric current source from the heating element and, therefore, deactivating the heating element. The bimetallic switch remains open as the tank water cools but closes again when the now-cooler water reaches the low set point, and the cycle repeats. A similar process occurs through operation of the bimetallic switch at the lower heating element. In water heaters using thermistors, the respective thermistors at the two heating elements output signals to a water heater controller that compares the temperatures represented by the signals to high and low set points stored in memory and controls relays that, in turn, open and close switches in the electric current paths between line current and the heating elements. The processor controls activation of the electric current switches responsively to the temperature signals from the thermistors to thereby activate the heating elements when the cooling tank water reaches the low set point and deactivate the heating elements when the now-heating water reaches the high set point, similar to the cycles executed by the bimetallic switches.

Under existing regulations, electric water heaters having a rated storage capacity of greater than 55 gallons are required to have an energy factor of 2.057 or greater. However, electric utilities that operate demand response programs may rely on electric water heaters in order to reduce/shift power usage during peak demand periods. As such, there is a need for the usage of electric water heaters with large storage capacities, even where achieving the required energy factor may not be feasible. With this in mind, Congress has enacted the Energy Efficiency Improvement Act of 2015, which allows the manufacture and sale of electric water heaters having rated storage tank capacities of greater than 75 gallons, as long as the electric water heaters include an activation lock that can only be activated by the utility. The activation lock is to be provided at the point of manufacture and, when in the locked position, disables a number of the water heater's electric resistance heating elements so that the required energy factor is achieved. The manufacturer of the electric water heaters provides an activation key for unlocking the activation lock, thereby allowing the flow of current to the previously disabled electric resistance heating elements, only to the utility conducting the demand response program in which the water heater is to be utilized. Only after the electric water heater is enrolled in the corresponding demand response program does the utility unlock the activation lock, thereby allowing current to flow to the corresponding electric resistance heating elements.

The accompanying drawings, which are incorporated in and constitute a part of this specification, illustrate one or more embodiments of the invention and, together with the description, serve to explain the principles of the invention.

SUMMARY OF THE INVENTION

The present invention recognizes and addresses considerations of prior art constructions and methods.

According to one embodiment, a water heater has a tank having a wall that defines a volume therein for holding water. At least one first heating element extends through the wall and into the volume and is configured for connection to a power source and so that, when connected to the power source, a portion of the at least one first heating element within the volume generates heat. A connector is configured for connection to the power source. The water heater includes a first electric circuit between the connector and the at least one first heating element. A switch defines at least two states, wherein the switch is disposed in the first electric circuit, and the first electric circuit is configured, so that, if the switch is in a first state, the first electric circuit is in an electrically conductive state between the connector and the at least one first heating element and, if the switch is in a second state, the first electric circuit is in an electrically non-conductive state between the connector and the at least one first heating element. A controller is in operative communication with the switch and is responsive to a key so that actuation of the controller by the key transitions the switch between the first state and the second state.

In a further embodiment, a water heater has a tank having a wall that defines a volume therein for holding water. A first heating element extends through the wall and into the volume and is configured for connection to a power source and so that, when connected to the power source, a portion of the first heating element within the volume generates heat. A second heating element extends through the wall and into the volume and is configured for connection to the power source and so that, when connected to the power source, a portion of the second heating element within the volume generates heat. A connector is configured for connection to the power source, and the water heater has a first electric circuit between the connector and the first heating element and a second electric circuit between the connector and the second heating element. A switch defines at least two states, wherein the switch is disposed in the first electric circuit, and the first electric circuit is configured, so that, if the switch is in a first state, the first electric circuit is in an electrically conductive state between the connector and the at least one first heating element via the switch and, if the switch is in a second state, the first electric circuit is in an electrically non-conductive state between the connector and the at least one first heating element. A controller is in operative communication with the switch and is responsive to a key so that actuation of the controller by the key transitions the switch between the first state and the second state.

In a still further embodiment, a water heater includes a water tank defining a volume, a plurality of electric heating elements extending into the volume of the water tank, a plurality of circuit loops, each circuit loop including a respective electric heating element of the plurality of electric heating elements so that when each circuit loop is complete between a power source and its respective heating element, each circuit loop causes electric current flow through the respective electric heating element to thereby generate heat in the water tank, and also including a respective thermostat that is both disposed adjacent the water tank so that the respective thermostat detects temperature of water in the water tank, and that is configured to complete and disable the respective circuit loop in response to a detected temperature. A circuit breaker is disposed in at least one of the plurality of circuit loops, the circuit breaker defining a conductive state in which the circuit breaker conducts electricity through the at least one respective circuit loop and a non-conductive state in which the circuit breaker disables electric current flow through the at least one respective circuit loop, the circuit breaker defining a key-controlled activation lock so that engagement of a key with the lock enables conversion of the circuit breaker between the conductive and non-conductive states.

The accompanying drawings, which are incorporated in and constitute a part of this specification, illustrate one or more embodiments of the invention and, together with the description, serve to explain one or more embodiments of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
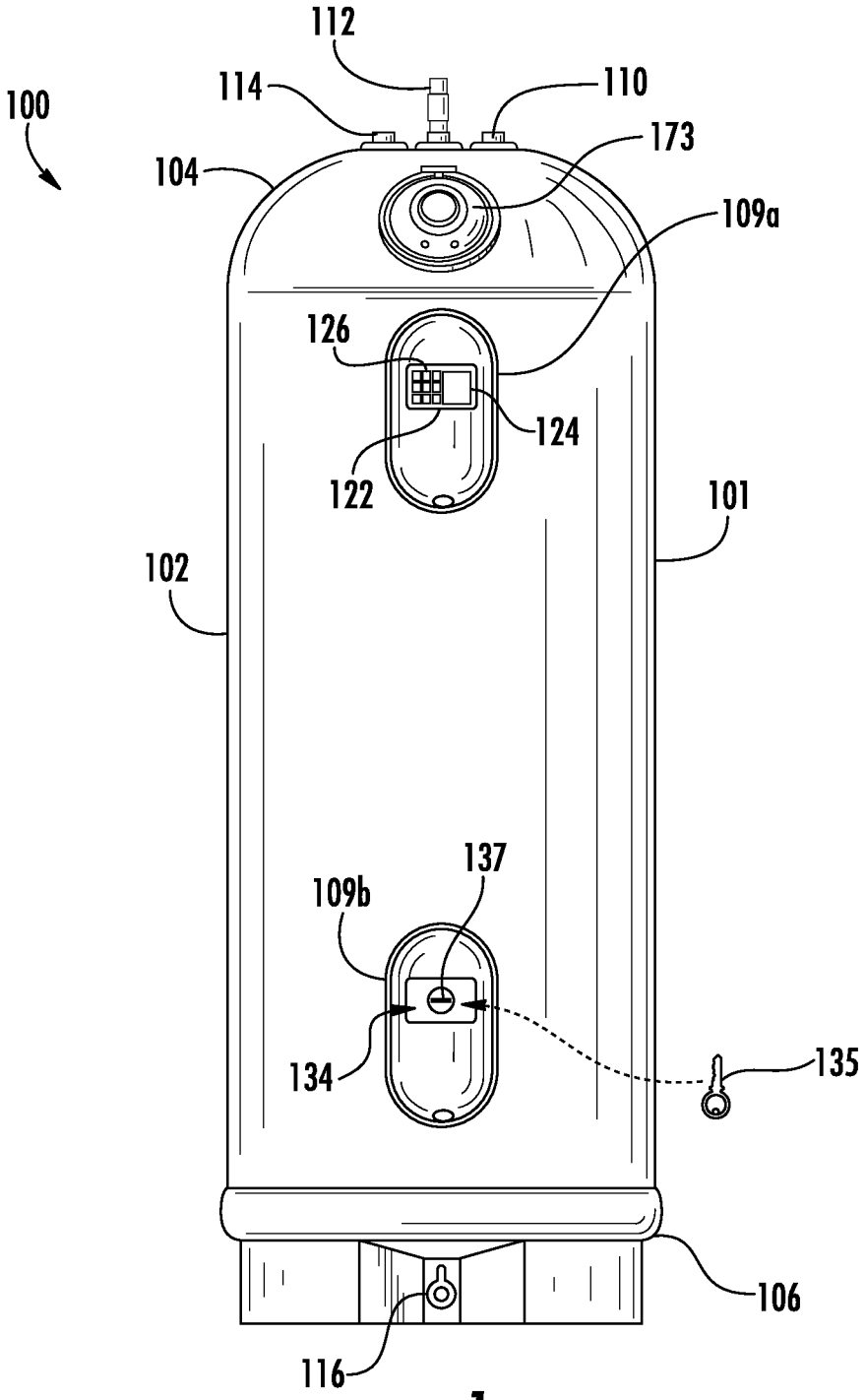
FIG. 1 is a front view of a water heater having an integrated activation lock in accordance with an embodiment of the present invention.

Repeat use of reference characters in the present specification and drawings is intended to represent same or analogous features or elements of the invention according to the disclosure.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
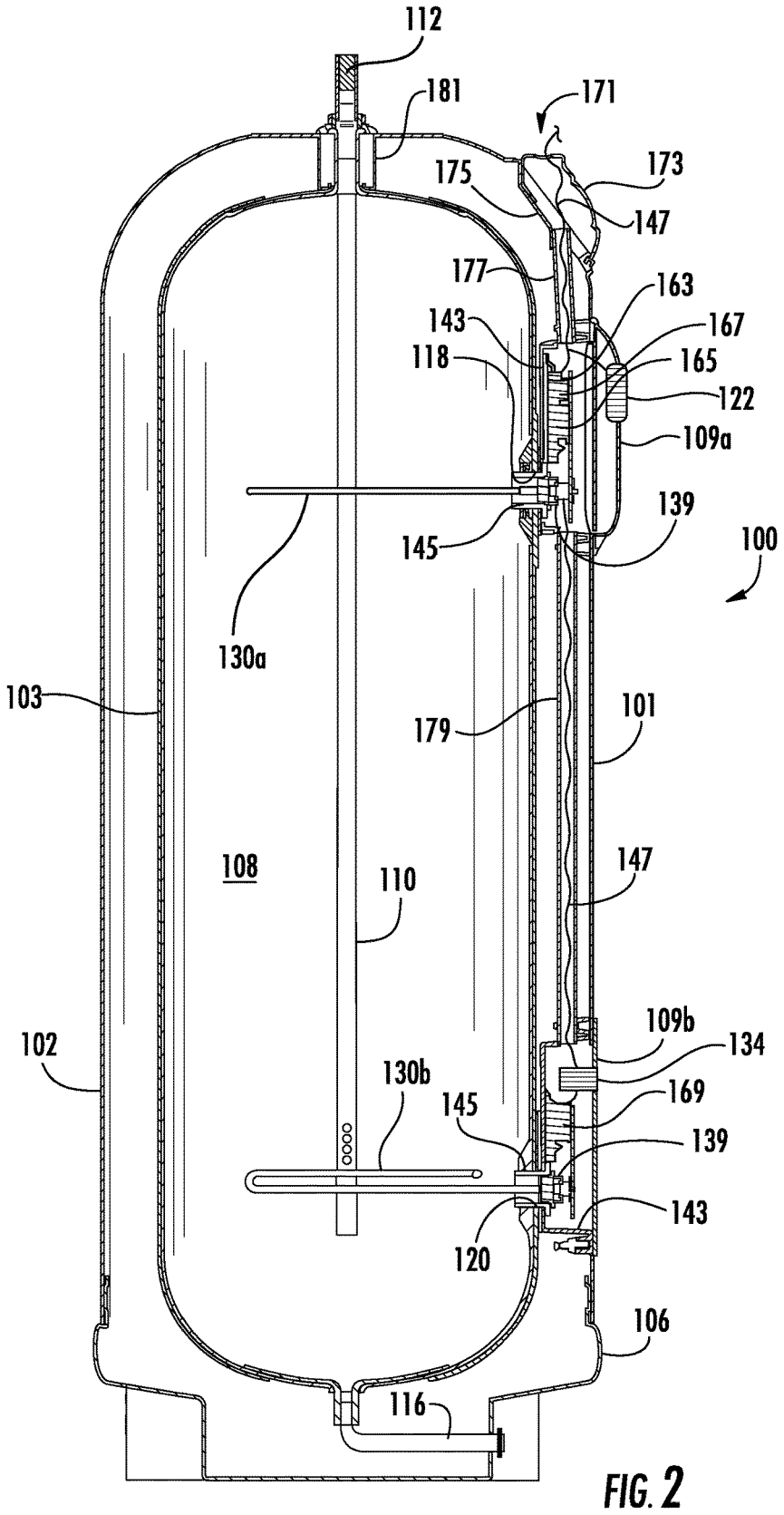
FIG. 2 is a side cross-sectional view of the water heater as in FIG. 1.

As used herein, terms referring to a direction or a position relative to the orientation of the water heater, such as but not limited to "vertical," "horizontal," "upper," "lower," "above," or "below," refer to directions and relative positions with respect to the water heater's orientation in its normal intended operation, as indicated in FIGS. 1 and 2 herein. Thus, for instance, the terms "vertical" and "upper" refer to the vertical direction and relative upper position in the perspectives of FIGS. 1 and 2 and should be understood in that context, even with respect to a water heater that may be disposed in a different orientation.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Referring now to FIGS. 1 and 2, a water heater 100 includes a vertically oriented, generally cylindrical body 101 that is defined by an outer wall having a domed top head portion 104, a bottom pan portion 106, a generally cylindrical side wall 102 extending therebetween and having an annular cross-section in a plane normal to the body's cylindrical center axis (which is vertical in FIG. 1), and a seamless, one-piece liner 103 disposed therein that defines an interior water tank volume 108 for receiving and holding water. Side wall 102 may be considered to encompass liner 103. As shown, side wall 102 is formed of a reinforced polypropylene-based polymer material, but it will be understood from the present disclosure that in other embodiments, other suitable polymer materials may be utilized, as well as steel or other metals, for side wall 102, head 104, and pan 106. Inner liner 103 may be formed from materials common to the construction of water heaters, for example a polymer, a carbon steel outer wall layer with a glass or porcelain enamel inner surface, or an uncoated stainless steel.

As should also be apparent from the present disclosure, the water heater wall's construction and configuration may vary, and the present disclosure is not limited to the constructions of the specific examples discussed herein. In another embodiment, for example, body 101 is formed of upper and lower body portions that are independently molded and later joined at a seam. The body portions are formed of a double walled construction rather than the wall-and-liner arrangement illustrated in the embodiment of FIGS. 1 and 2. The process by which body portions are manufactured is discussed in greater detail in U.S. Pat. No. 5,923,819, issued Jul. 13, 1999, the entire contents of which are incorporated herein by reference, and a detailed description of the process is therefore not repeated herein.

As shown in FIGS. 1 and 2, a cold water inlet pipe 110, a hot water outlet fitting 112, and a temperature and pressure release valve 114 extend through suitable openings defined in the water heater's domed top head portion 104. A valve drain pipe 116 extends inwardly through bottom pan portion 106. A pair of top and bottom vertically spaced electric resistance heating elements 130*a* and 130*b* extend radially inwardly into interior tank volume 108 through a pair of corresponding top and bottom apertures 118 and 120 that are formed in liner 103 and in respective recessed housings 143 that are disposed and extend between liner 103 and side wall 102 of the water heater's body 101. Housings 143 include or cooperate with respective covers 109*a* and 109*b* that cover electrical fittings 139 of electric resistance heating elements 130*a* and 130*b*. Cylindrical bushings 145 extend through top and bottom apertures 118 and 120 and are fixed to inner liner 103, for example by welding to a metal liner, mounting to a polymer liner, or connection by other suitable means. Electrical fittings 139 of top and bottom heating elements 130*a* and 130*b* define external threads that cooperate with internal threads on top and bottom bushings 145, so that top and bottom heating elements 130*a* and 130*b* can be threadedly secured to liner 103 via bushings 145 and so that the heating element portions of top and bottom heating elements 130*a* and 130*b* can be maintained in position within water tank volume 108.

Each electric resistance heating element 130*a*/130*b* includes an electric resistance heating element extending outwardly from a cylindrically-shaped base portion on which the above-described threads are defined and that houses electrical fitting 139. In the illustrated embodiment, the heating element portion is defined in an elongated-U shape, which is illustrated in frontal view in FIG. 2 for bottom heating element 130*b* but in side view for top heating element 130*a*, the difference in orientation being due simply to the rotational position of the heating element assemblies as they are threaded into position.

During typical operations of water heater 100, cold water from a pressurized source flows into water heater interior volume 108, wherein the water is heated by top and bottom electric resistance heating elements 130*a* and 130*b* and stored for later use. As should be understood, water within volume 108 is subject to pressure from water provided from a municipal cold water source via water inlet pipe 110. Thus, the opening of a valve at an appliance or faucet in the hot water delivery system downstream from hot water outlet fitting 112 creates a pressure at hot water outlet 112 that is lower than the pressure within volume 108. This pressure differential causes the flow of water from interior volume 108 to the lower-pressure hot water outlet system. The discharge of heated water outwardly through hot water outlet fitting 112 creates capacity within volume 108 that is correspondingly filled by pressurized cold water that flows downwardly through cold water inlet pipe 110 and into volume 108. This lowers the temperature of water in the tank, which is in turn heated by top and bottom heating elements 130*a* and 130*b*. A control board processor (described below) monitors temperature of water in the tank based on signals received from one or more temperature sensors (discussed below) actuating the resistive heating components of top and bottom heating elements 130*a* and 130*b* when the processor detects a water temperature below a predetermined low threshold value. The heating elements are maintained in an actuated state until the processor detects water temperature above a predetermined high threshold value, where the high threshold is greater than the lower threshold as should be understood.

A power source provides electric current to the respective resistive heating components of top and bottom heating elements 130*a* and 130*b* via electrical fittings 139. A bracket 163 is secured to an outer surface of cylindrical wall portion 147 of top heating element 130*a* as it extends outward of inner liner 103. Bracket 163 secures a temperature sensor 165, for example a thermistor, so that the thermistor abuts a bottom surface of its housing 143 or extends through a hole in the bottom of housing 143 so that the thermistor abuts inner liner 103. As indicated in FIG. 2, thermistor 165 is positioned just above top heating element 130*a* so that it detects, through the wall of inner liner 103, the temperature of water proximate the heating element. Bracket 163 also secures a circuit board on which are disposed components, indicated generally at 167, including a power supply and a controller. Also as discussed below, and also as generally indicated at 167, an emergency cutoff device, or "ECO," may be secured by the bracket. A similar bracket may be secured about the portion of bushing 145 extending outward of inner liner 103 to secure and position a second thermistor 169, again either abutting the bottom of its housing 143 or extending through a hole in housing 143 to directly abut inner liner 103. In another embodiment, as illustrated in FIG. 2, lower thermistor 169 is directly secured to housing 143, without need of a bracket.

A DC power source (FIG. 4, 193) within the circuitry indicated at 167 receives AC power from a building mains power source from wiring 147 that extends through a hole 171 in a cover 173 that encloses an upper housing 175 in which a wiring harness (not shown) is disposed. Wiring 147 ends, at its end opposite the heating element circuitry illustrated in the figures, in a conventional three-pronged connector that plugs into a receptacle in a mains power line of the building in which the water heater is located, so that an electric current loop is completed between the mains power supply and the heating element, as indicated in FIGS. 4-8. From the wiring harness, electric current is conveyed by the wires through an upper conduit 177 to the circuitry indicated at 167, as well as electrical fitting 139 of top heating element 130*a*. Wiring 147 extends through a lower conduit 179 and carries electric current to electrical fitting 139 of bottom heating element 130*b*. In the embodiment shown, an activation lock 134 is disposed in the circuit that provides current to bottom heating element 130*b*, specifically in the portion of wiring 147 disposed between controller 195 (FIG. 4) and bottom heating element 130*b*, to act as a circuit breaker. Activation lock 134 comprises a single pole switch in a circuit section (which may be considered an independent circuit) between the AC power source and heating element 130*b*. In one state of the switch, the switch is open, so that it is non-conductive and so, therefore, the circuit section does not convey electric current from the AC source to the heating element. In its other state, the switch is closed, so that it is conductive and so, therefore, the circuit section conveys electric current from the AC source (when the connector is connected to the supply) to the heating element. The activation lock includes a mechanical controller, in this example a key-activated pin tumbler lock, the construction of which should be understood and is, therefore, not discussed in further detail herein. An output driver of the pin tumbler lock mechanically connects to the switch's input drive, so that rotation of the tumbler of activation lock 134 from a locked to an unlocked position moves the single pole switch in the corresponding circuit of bottom heating element 130*b* from the non-conductive state (open) to the conductive state (closed) so that current can be supplied to bottom heating element, as discussed in greater detail below. Wiring also extending through lower conduit 179 conveys output signals from thermistor 169 to the controller, which is housed at 167.

It will be understood in this art that the volume between inner liner 103 and sidewall 102, head 104, and pan 106 may be filled with foam insulation that is injected as a liquid into the volume and allowed to expand. Housing 143 protects the components disposed therein and described above from being encased in foam, and foam dams, for example as indicated at 181, may be disposed at positions within the volume, for example surrounding water exit tube 161, in which it may be desired to avoid foam. Wiring conduit 177 and 179 also serve this purpose, but it should also be understood that in other embodiments, the conduit may be omitted, so that the wiring is encased in foam.

Figure 3:
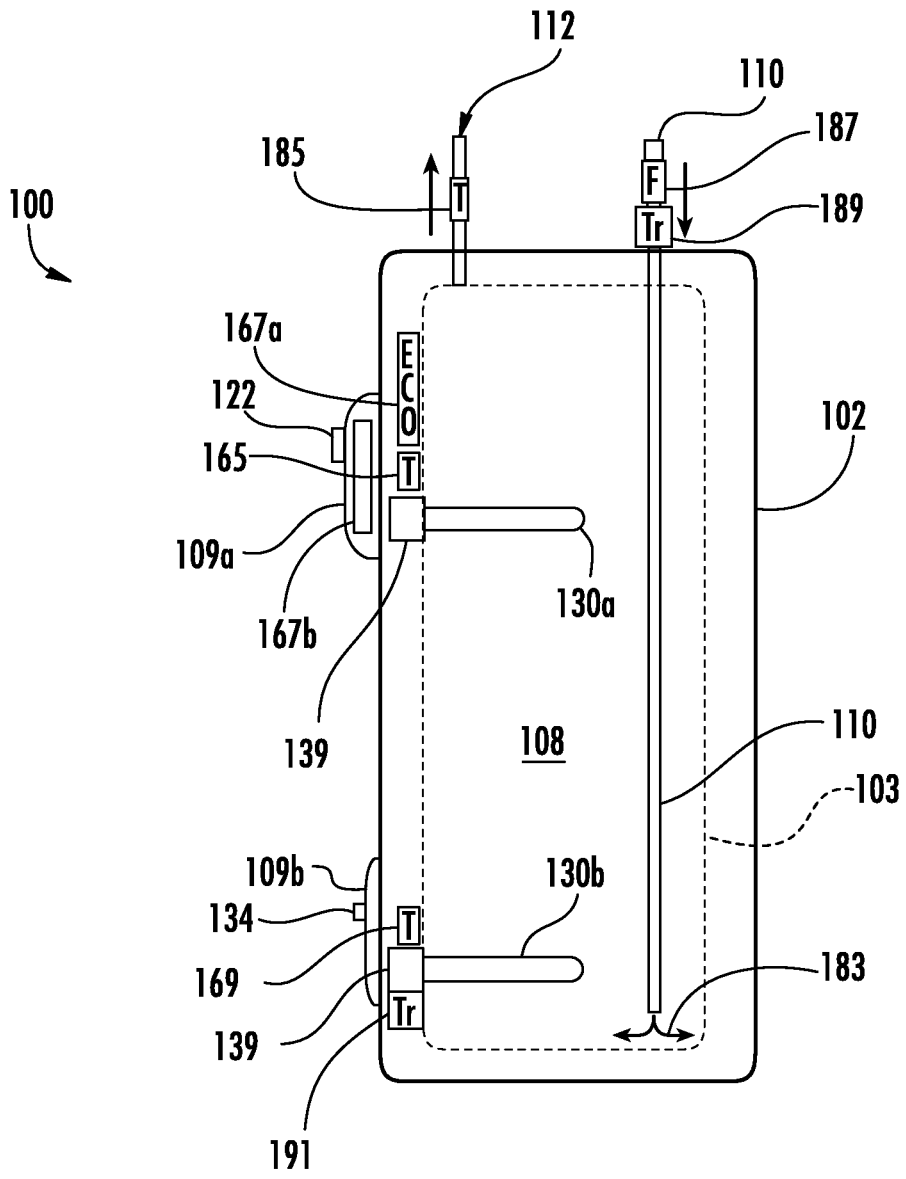
FIG. 3 is a schematic illustration of the water heater as in FIG. 1.

Referring to FIG. 3, during typical operations of water heater 100, cold water from a pressurized source (for example, a municipal cold water supply) flows into water heater interior water tank volume 108 through inlet tube 110 as indicated by arrows 183. As indicated, cold water generally enters the tank in the bottom part of volume 108. The pressurized water fills the tank, and top and bottom heating elements 130*a* and 130*b* heat the water. As should be understood, cooler water is more dense than warmer water, causing the cooler water to move toward the bottom of the volume and warmer water to move toward the top. This convection effect tends to create movement of water within the tank that, over time, tends to equalize temperature across the tank volume. Accordingly, when plumbing fixtures (not shown) to which water heater 100 is connected within the building or other facility within which water heater 100 is installed are inactive, water temperature throughout the tank tends to equalize. When one or more valves of the hot water outlet system to which water heater 100 is attached via fitting 112 require hot water (i.e., are opened), hot water flows through hot water outlet fitting 112 to the hot water supply piping (not shown). The discharge of heated water outwardly through hot water fitting 112 creates a capacity within volume 108 that is correspondingly filled by pressurized cold water that flows downwardly through cold water inlet pipe 110 and into volume 108. This tends to lower the temperature of water in the tank. The cooling water is heated, however, by electric resistance heating elements 130*a* and 130*b*.

As water is drawn out of hot water outlet fitting 112, water flowing out of the hot water outlet could remain indefinitely at a constant warm temperature if the top and bottom heating elements 130*a* and 130*b* could raise the temperature of the now-cooling water in the tank at a sufficient rate before the water flows out of hot water outlet 112.

Figure 4:
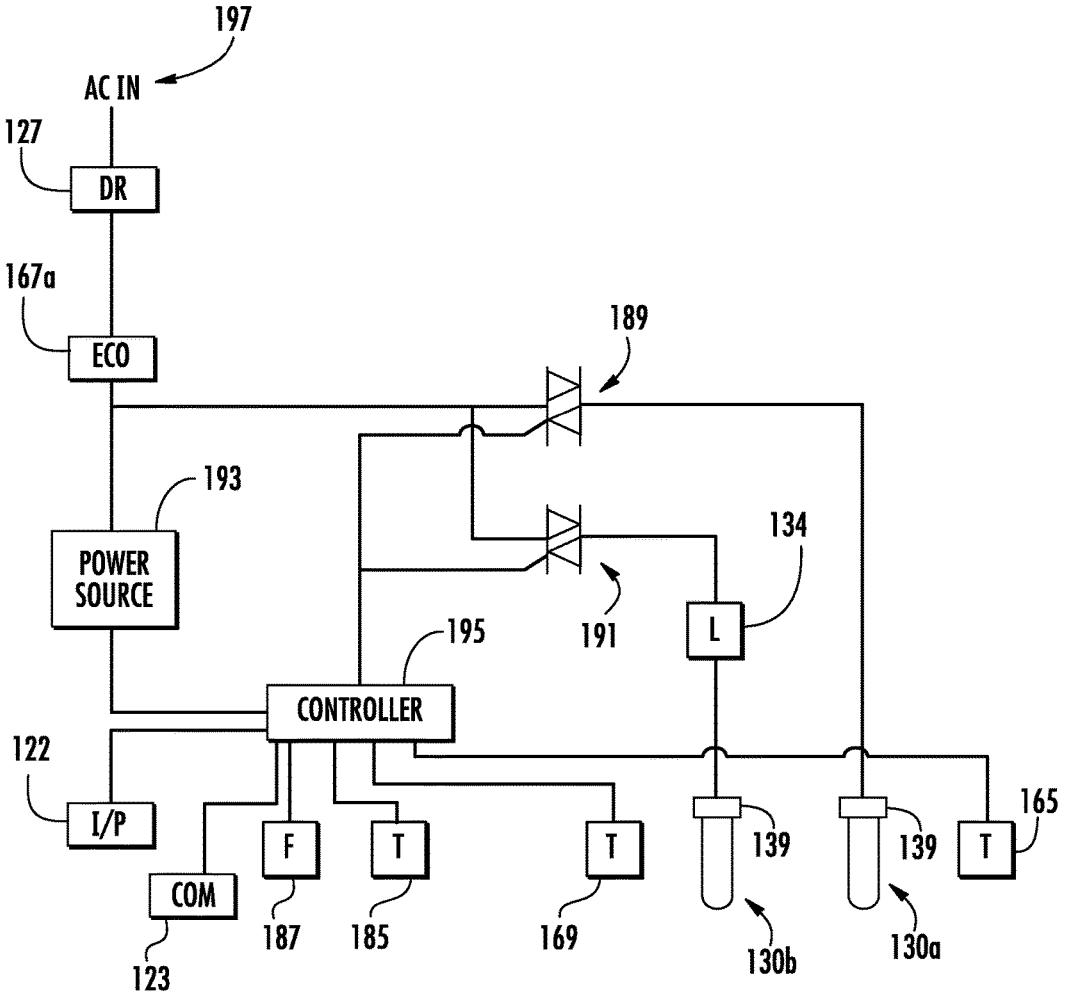
FIG. 4 is a partial schematic illustration of the water heater as in FIG. 1.

Referring to FIGS. 3 and 4, a temperature sensor 185 is disposed on hot water outlet fitting 112. A flow sensor 187 is disposed on inlet tube 110 just outside the body of tank 100. A first triac 189 is disposed at the inlet pipe proximate the flow sensor. A second triac 191 is disposed in the lower housing 143. As should be understood, triacs generate heat when in use. Thus, the placement of the triacs on the cold water inlet and at the bottom portion of liner 103 places the triacs opposite cold or relatively cold (with respect to water in the upper part of volume 108) water, so that the triacs contribute heat to the tank water. In other embodiments, however, the triacs are placed on a circuit board with other components shown in FIG. 4.

While in FIG. 2, the emergency cutoff device and other circuitry is indicated collectively at 167, in FIGS. 3 and 4 the emergency cutoff device is indicated individually at 167*a*. A DC power supply 193 and a controller 195 are disposed on a circuit board located within upper housing 143 (FIG. 2), as indicated at 167*b*. An upper component 122 of an input interface (FIGS. 2 and 3) includes a processor (not shown), memory (not shown), a display 124 (FIG. 1) and key pad 126 (FIG. 1), and is disposed on cover 109*a*. Input interface component 122 is in communication with controller 195 by way of electrical connections on the circuit board disposed within upper housing 143. More specifically, the processor of interface component 122 communicates with the processor of controller 195 via a wired connection and input/output circuitry at the respective devices, as should be understood in this art. The arrangement of the controller and other electrical components of water heater 100 are illustrated schematically in FIG. 4. The processor of upper interface component 122 monitors and receives keystroke data from key pad 126, processes input data corresponding to keystrokes from the key pad, and transmits the corresponding data to controller 195. The water heater operator may provide data, for example upper and lower set point data, to controller 195 upon which controller 195 may rely in execution of an algorithm that controls the provision of electric power to the heating elements, as described herein.

In some embodiments, the input interface includes a lower component 123 that facilitates communication with a computing device remote from controller 195 and thereby effects selective communication of the remote computing device with controller 195 via lower component 123. For example, lower component 123 may comprise a USB, RS232, or other wired communication port with an input/output processor that manages transmission of data to and from the port. In such embodiments, a computing device, such as a personal computer, may be selectively connected to lower component 123 via a removable cable connection, so that an application program resident at the remote computer permits a user at the computer to enter data via the remote computer and communicate that data to the control program executed by controller 195, via the communication port at 123. Alternatively, or in addition, lower component 123 may comprise one or more antennas, a transmitter and a receiver in operative communication with the one or more antennas, a processor such as a digital signal processor that controls the operation of the transmitter and receiver, and related circuitry (e.g. one or more local oscillators) in support of these components, as will be understood may be utilized in wireless communication devices. As will be understood, such wireless communication devices may be configured to operate with any of various mobile data communications networks such as GSM, CDMA, GPRS, W-CDMA, or LTE. An operator of a mobile device remote from the water heater may enter data into the remote mobile computing device via that device's interface, e.g. a touch screen or key pad, so that an application resident on the remote mobile device controls a wireless communications device on the remote mobile device to transmit data, corresponding to the data input by the remote user, over the wireless network to the mobile communications device at lower component 123. An antenna at lower component 123 receives the signal from the wireless network and routes the resulting signal to the receiver, which in turn amplifies the signal, converts the signal to digital form, and performs other processing functions. The receiver outputs corresponding digital data to the digital signal processor, which demodulates and decodes the signal and provides corresponding data to controller 195. Alternatively, or in addition, lower component 123 may comprise a near-field communication (NFC) device that effects short-range communications over an NFC protocol such as defined by radio frequency identification (RFID) or Bluetooth standards. An NFC-enabled mobile device may support an application program and an interface device so that an operator of the remote mobile device may enter data to the mobile device processor and the application program and, when the mobile device is brought sufficiently close to the NFC device at lower component 123 to communicate with the lower component NFC device, enter an instruction to the mobile device to transmit the entered data to the NFC device at lower component 123. A processor at the lower component NFC device acquires and processes the data and transmits the acquired data to controller 195. Still further, an application program on an NFC enabled key fob may activate, when the fob is brought sufficiently close to the NFC enabled component 123, to transmit predetermined data to the NFC device at lower component 123. For example, an application program at the key fob may be configured to always transmit an unlock code, or to always transmit a lock code, or to transmit either an unlock code or a lock code, depending on an input to the key fob processor actuated by an operator of the key fob.

It will be understood from the present disclosure that the functions ascribed to controller 195 and interface components 122 and 123, as well as remote computing devices communicating with component 123, may be embodied by respective computer-executable instructions of respective programs that are embodied on computer-readable media and that execute on one or more computers, for example embodied by a processor such as a microprocessor or a programmable logic controller (PLC) that execute the program instructions to perform the functions as described herein. The one or more computers of controller 195, upper component 122, lower component 123, and the remote computing device may each be considered to comprise a controller in that the computer(s) is a computer that controls operation of another device, in the case of controller 195, for example, the water heater. Any suitable transitory or non-transitory computer readable medium may be utilized. The computer readable medium may be, for example but not limited to, an electronic, magnetic, optical, electromagnetic, infrared, or semiconductor system, apparatus, or device. More specific examples of the computer readable medium include, but are not limited to, the following: an electrical connection having one or more wires; a tangible storage medium such as a random access memory (RAM), a read-only memory (ROM), an erasable programmable read-only memory (EPROM or flash memory), a non-volatile memory supporting a PLC, memory incorporated into a processor, or other optical or magnetic storage devices. Generally, program instructions, e.g. in modules, include computer code, routines, programs, components, data structures, etc., that perform particular tasks and/or implement particular abstract data types. Moreover, those skilled in the art will appreciate that the systems/methods described herein may be practiced with various controller configurations, including programmable logic controllers, simple logic circuits, single-processor or multi-processor systems, remote and mobile devices, and the like. Aspects of these functions may also be practiced in distributed computing environments, for example in so-called "smart home" arrangements and systems, where tasks are performed by remote processing devices that are linked through a local or wide area communications network to the components otherwise illustrated in the figures, as described above. In a distributed computing environment, programming modules may be located in both local and remote memory storage devices. Thus, each of controller 195, interface component 122, and interface component 123 may comprise a computing device that communicates with the system components described herein via hard wire or wireless local or remote networks and may itself comprise in whole or in part a processing device remote from water heater 100 and that communicates with other components at the water heater wirelessly or by other means.

A controller that could effect the functions described herein could include a processing unit, a system memory and a system bus. The system bus couples the system components including, but not limited to, system memory to the processing unit. The processing unit can be any of various available programmable devices, including one or more microprocessors and/or PLCs, and it is to be appreciated that dual microprocessors, multi-core and other multi processor architectures can be employed as the processing unit.

Software applications may act as an intermediary between users and/or other computers and the basic computer resources of controller 195, interface component 122 and interface component 123, as described, in suitable operating environments. Such software applications include one or both of system and application software. System software can include an operating system that acts to control and allocate resources of controller 195 and the controllers/processers of interface component 122 and interface component 123. Application software takes advantage of the management of resources by system software through the program models and data stored on system memory.

Controller 195 may also, but does not necessarily, include one or more interface components (e.g., to communicate with interface component 122 and/or interface component 123) that are communicatively coupled through the bus and facilitate interaction with controller 195 by those devices. By way of example, the interface component can be a port (e.g., serial, parallel, PCMCIA, USC, or FireWire) or an interface card, or the like. The interface component can receive input and provide output (wired or wirelessly). For instance, input can be received from interface component 122, which may include, but is not limited to, a pointing device such as a mouse, track ball, stylus, touch pad, key pad, touch screen display, keyboard, microphone, joy stick, or other component. Output can also be supplied by controller 195 to output devices (e.g. interface component 122, which has a screen to display output information) via the interface component. Output devices can include displays (for example cathode ray tubes, liquid crystal display, light emitting diodes, or plasma) whether touch screen or otherwise, speakers, printers, and other components. In particular, by such means, controller 195 may receive inputs from, and direct outputs to, the various components with which controller 195 communicates, as described herein.

An AC electrical input source 197 may be, or may be a connection to, a connection to the electric mains from the building in which water heater 100 is located. Emergency cutoff device 167*a* is a temperature sensing device disposed against inner liner 103 so that device 167*a* detects the temperature of water in the upper part of volume 108. Device 167*a* may be, for example, a bimetallic switch that is normally closed but that opens when the temperature of water opposing device 167*a* across the wall of inner liner 103 reaches or exceeds a predetermined temperature defined by the configuration of the bimetallic switch. The bimetallic switch is mechanically connected to a single pole switch so that the single pole switch is closed when the bimetallic switch is closed, and the single pole switch is open when the bimetallic switch is open. AC electric current flows through the single pole switch to DC power supply 193 and top and bottom triacs 189 and 191, respectively. Accordingly, when the bimetallic switch is in its normally-closed condition, the single pole switch is closed, thereby allowing electric current to flow from AC input 197 to DC power supply 193 and triacs 189 and 191 or other switches as may be used in the circuit. When, however, the temperature of water within tank 100 opposite electric cutoff device 167*a* exceeds a predetermined threshold indicating the likelihood that the tank will output water above a predetermined threshold temperature, for example 120° F., the bimetallic switch opens, thereby opening the single pole switch and disconnecting electric current from the power supply and the two triacs. The bimetallic switch may be configured to close where the temperature of water falls back below the high set point, thereby allowing current to again flow to these components and system operation to continue. Alternatively, once the bimetallic switch opens and disables the water heater, the switch remains open until reset by an operator.

Temperature sensor 185, for example a thermistor, is disposed at hot water outlet 112. The output of this temperature sensor is directed to controller 195, which utilizes the temperature sensor output in controlling the operation of top heating element 130*a*, as described in more detail below.

DC power source 193 receives an AC input signal from AC input 197 via emergency cutoff device 167*a* and converts the AC input to a DC power source, for example powering components, such as controller 195, that require DC power. The construction and arrangement of DC power sources should be understood and are, therefore, not discussed in further detail herein.

As noted above, activation lock 134 may include a key-activated pin tumbler lock, with the pin tumbler output shaft or driver in driving connection with the input driver of a single pole switch that is disposed in the circuit loop of bottom heating element 130*b* between the output of bottom triac 191 and the heating element. The pin tumbler of activation lock 134 is mechanically connected to the single pole switch so that the single pole switch is open when the pin tumbler is in its locked position and the single pole switch is closed when the pin tumbler is in its unlocked position. When the single pole switch is closed (conductive state), AC electric current is able to flow through bottom triac 191 and the single pole switch to bottom heating element 130*b*. When activation lock 134 is in its as-shipped condition, however, the single pole switch is in its open (non-conductive) state, and the pin tumbler lock is in its locked state, thereby preventing electric current flow from AC power supply 197 to bottom heating element 130*b* by way of bottom triac 191. Once water heater 100 is installed and enrolled in a demand response program of a participating utility, an authorized person (e.g. a service representative of the participating electric utility) inserts a key 135 (FIG. 1) that is receivable in a key slot 137 of lock 134 and that has a mechanical configuration that cooperates with the tumbler configuration so that the key may be moved within the tumbler lock to drive the lock's output drive shaft. In certain embodiments, the lock may be configured so that only one key configuration is capable of moving the lock between states of the lock. The authorized person then turns the key, which moves the pin tumbler of activation lock 134 to the unlocked position. Because the lock's output driver correspondingly drives the switch input, the service representative thereby moves the corresponding single pole switch to the closed position. This causes electric current from power supply 197 to thereafter be provided to the bottom heating element by way of bottom triac 191. The key for operating activation lock 134 is provided to the corresponding utility by the manufacturer of the water heater.

Inclusion in a demand response program typically requires that the utility provide a demand response controller system 127 (FIG. 4) that allows the utility to communicate with, and thereby regulate the energy usage of, the electric water heater. For example, the utility may communicate with demand response controller system 127 through mobile cellular communications systems, e.g. utilizing the global system for mobile communications (GSM) standard in a mobile data services, e.g. the general packet radio service (GPRS), that operates under such a standard, or through a Wi-Fi Internet connection. Through such communications with demand response controller system 127 by a remote computer over such a distributed network, the utility may provide instructions to the demand response controller system. In turn, demand response controller system 127 may actuate circuitry in communication with the A/C power input line to, e.g., disable or modulate input power to the water heater circuitry illustrated at FIG. 4 during certain peak usage periods or at other times, depending on the utility's load and capacity at a given time period. Alternatively, demand response controller system 127 might not communicate directly with the power input but may, instead, communicate with controller 195 to allow the utility to transmit instructions to controller 195 so that controller 195 disables or modulates the application of input electrical power to the heating elements during such peak usage periods or other times. Still further, where lower interface component 123 is present, discrete demand response controller system 127 may be omitted, and the utility may communicate with controller 195 to provide instructions to disable or modulate electrical power to the heating elements via lower interface component 123, such that lower interface component 123, in conjunction with controller 195, embodies the demand response controller system.

The placement of activation lock 134 can be varied within the circuit loop that provides current to bottom heating element 130*b*. For example, referring to FIG. 5, rather than being disposed in the circuit between bottom triac 191 and bottom heating element 130*b*, activation lock 134 may be disposed upstream of bottom triac 191, between itself and controller 195.

Figure 5:
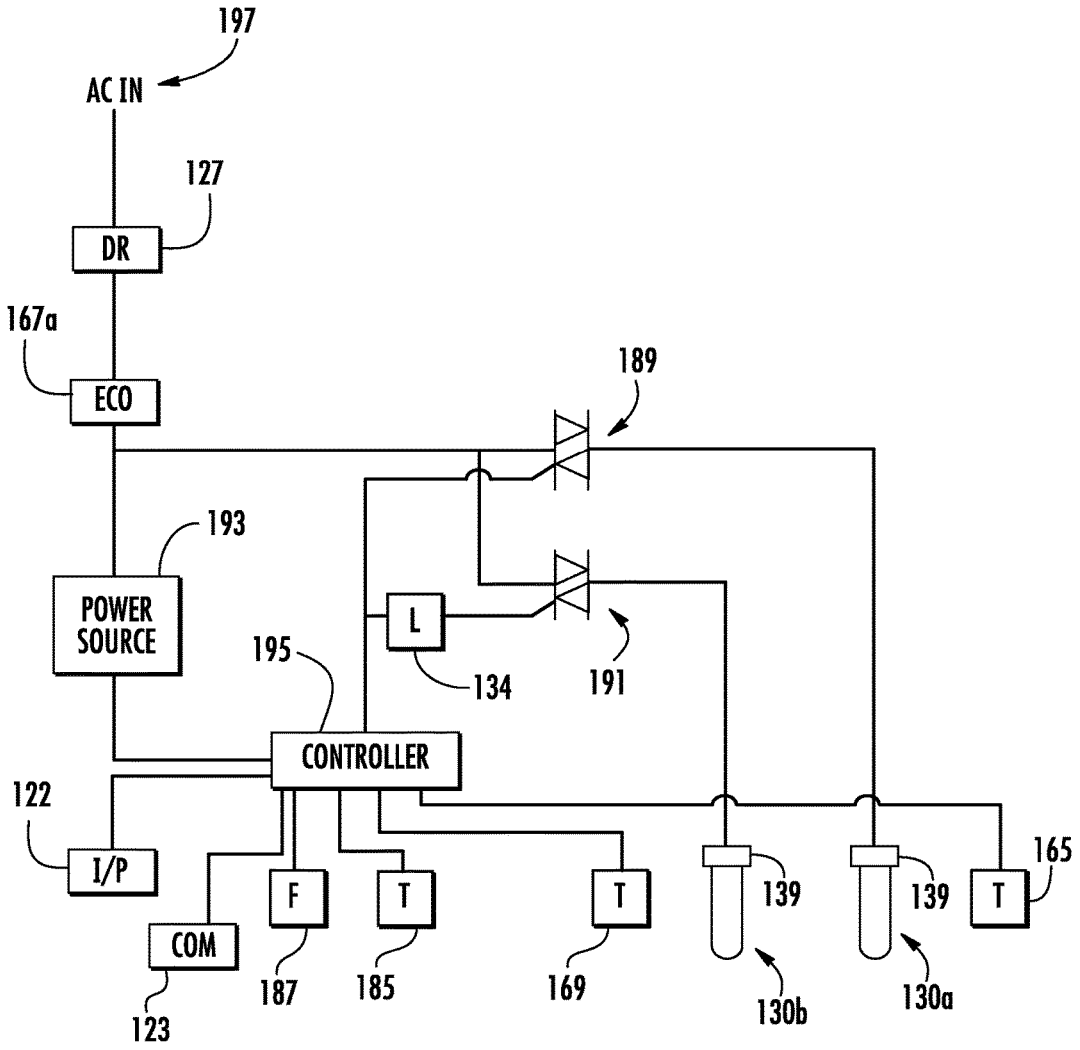
FIG. 5 is a partial schematic illustration of an alternate embodiment of a water heater in accordance with the present invention.
Figure 6:
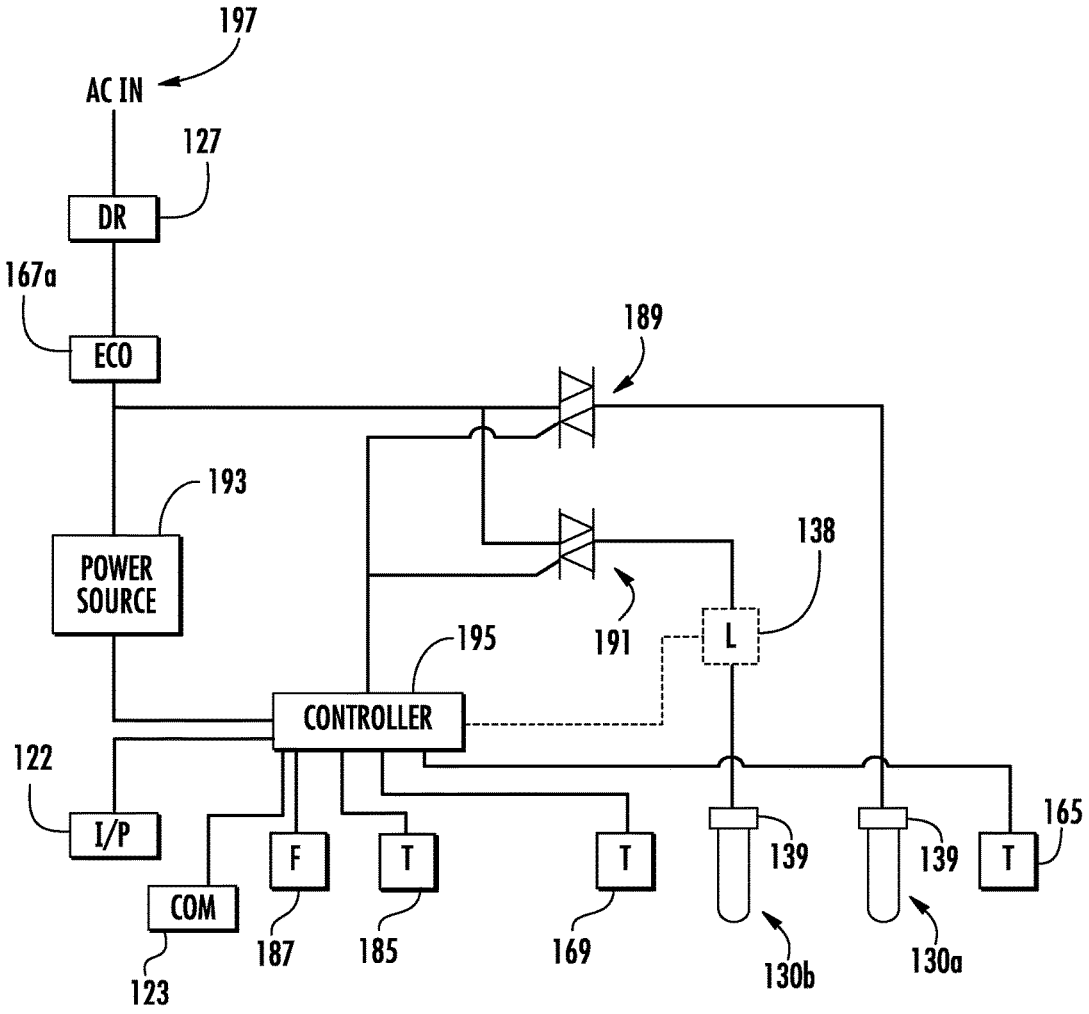
FIG. 6 is a schematic illustration of an alternate embodiment of a water heater in accordance with the present invention.

Referring now to FIG. 6, in a still further embodiment, an electronic controller, or activation lock, 138 may be utilized to enable/disable the flow of current to bottom heating element 130*b* rather than the previously discussed mechanical controller. For example, activation lock 138 may be embodied, at least partially, in computer-executable instructions of a program on the computer-readable medium of the water heater's controller 195 (and that is executed by controller 195) and, in certain embodiments, in circuitry between triac 191 and heating element 130*b* that is controlled by controller 195 in response to the controller's execution of such instructions and that disables current flow from the triac to the heating element. Before the demand response controller system 127 is installed, whether in the form of a discrete physical device as in FIGS. 4-8 or in the establishment of a communications path between controller 195 and a remote computing device at the utility via a distributed network and lower interface controller 123, activation lock 138 is in a "locked" condition in that the program of controller 195 is initially set to disable (by disabling triac 191 via control of the triac's gate signal or by actuation of disabling circuitry between the triac output and the heating element) the flow of electric current to lower heating element 130*b*. When the demand response controller system is thereafter installed, a user (e.g. an authorized representative of the utility, having been provided an alphanumeric activation code by the water heater manufacturer) enters the alphanumeric code, for example by entering the "unlock" code via key pad 126, so that the I/O processor at upper interface component 122 transmits data corresponding to the code to controller 195, which in turn activates triac 191 to operate normally in response to the controller's normal, two-element operation algorithm or controls disabling circuitry between the triac and its heating element to permit full current flow. Alternatively, the utility user may communicate with controller 195 via a remote computer, the distributed network, and lower interface component 123, so that the user enters the alphanumeric unlock code via the remote computer's input system, and the application program operating on the remote computer forwards the received code to controller 195 via wired or wireless communication with lower interface component 123 as described above. Still further, the user may communicate the "unlock" code to controller 195 by bringing a mobile device or key fob having NFC capability into sufficiently close proximity to an NFC-enabled lower interface component 123 that the mobile device/key fob can communicate with the lower interface component via the NFC communications link. Where the user utilizes a mobile device, the user may enter the unlock code via an input device on the mobile device (or selection of a previously stored code at the mobile device's memory), so that the mobile device transmits the code to the lower interface component over the NFC link. Where a key fob is used, the fob may have a code stored in its memory so that when the fob is brought into sufficiently close proximity to the NFC device at interface component 123, the devices automatically communicate and the fob automatically transmits the code down to the controller 195 via the interface component.

Accordingly, to enable the flow of current to bottom heating element 130*b* when the system is in a locked condition, activation lock 138 is transitioned to the "unlocked" position upon the user's input of the alphanumeric activation code into controller 195 via a keypad (e.g. keypad 126, FIG. 1), touchscreen or other input device of a mobile or personal computer, or via a preprogrammed non-interactive device such as a key fob. As described above, the processor at upper input component 122 or lower component 123 receives the input data from the interactive or non-interactive device and transmits the received data to controller 195. In this embodiment, the activation code is a sequential series of alphanumeric data representing a code programmed into the program instructions of controller 195 by the manufacturer of the water heater that the representative inputs to controller 195 utilizing the key pad, key fob, or other device.

The system may also support "lock" alphanumeric codes. If controller 195 is in the unlocked mode, such that the controller has enabled triac 191 or activated circuitry between the triac and the heating element to disable that current flow, a user at a remote computing device or key pad 126 may enter the alphanumeric "lock" code to controller 195 through keypad 126 or any of the other mechanisms discussed above. Upon receipt of the lock code, controller 195 moves the operation of the water heater system from the unlocked to the locked condition, for example disabling triac 191 or electronically blocking current flow from the triac to the heating element. The lock and unlock codes may be different from each other, or they may be the same (so that each time controller 195 receives the code, it changes state between locked and unlocked conditions, regardless in which of the conditions it may be at a given time). In particular where the codes are the same, a preprogrammed NFC-enabled fob that stores and transmits a single code can be used to lock and unlock the water heater as desired, by successive movements of the fob into proximity with the NFC-enabled lower interface component.

Figure 7:
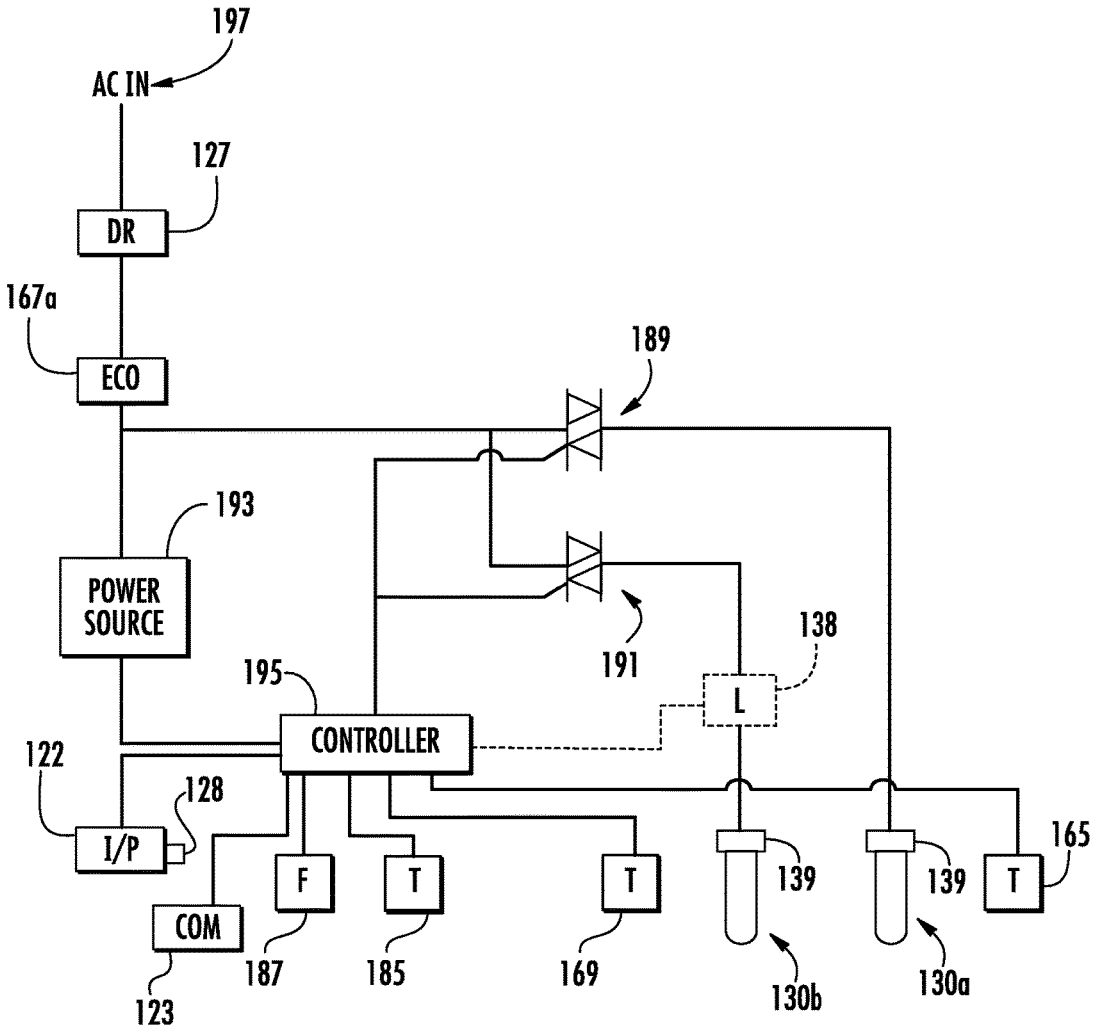
FIG. 7 is a schematic illustration of an alternate embodiment of a water heater in accordance with the present invention.

Referring additionally to FIG. 7, in an alternate embodiment, input interface component 122 or 123 is provided with a communication port for receiving a dongle 128. "Dongle" is a term commonly used to refer to a small piece of hardware that, when connected to another device, such as controller 195, provides data, programming, or services to the receiving device. In the present embodiment, dongle 128 is a piece of hardware provided by the manufacturer of the water heater to the utility that communicates with processor 195 to thereby transition activation lock 138 to the unlocked position, thereby allowing the flow of current to bottom heating element 130*b* after the water heater is enrolled in a demand response program.

Dongle 128 includes memory, a communications interface, and may include a processor. Stored in the memory is a code as described above or other data instruction that is configured, in conjunction with the program instructions stored in association with controller 195, so that when controller 195 receives the instruction from dongle 128, controller 195 transitions activation lock 138 from the locked to the unlocked position. Input interface component 122 and/or component 123 includes a port, such as a USB port, configured to receive the dongle. A processor at interface component 122 or component 123 intermittently checks the port to determine if a device is connected to the port or a data bus to determine if messages and received from the port. In either case, upon detecting presence of the dongle at the port, the interface component 122 or 123 processor, according to its programming, reads the data on dongle 128, identifies and reads the instruction/code stored thereon, and forwards the instruction to controller 195, which, in turn, switches the lock. In a still further embodiment, electronic/software activation lock 138 can be enabled/disabled by means of a digital signal sent from the utility and received by input device 122, utilizing any of the previously noted wireless communication forms.

Activation lock 138 is represented in dotted lines in FIGS. 6 and 7 merely to represent that a mechanical lock (e.g. a pin and tumbler lock) is not present in the circuit. Controller 195, triac 191, and the controller's program instructions embody the activation lock in this configuration, in that when conditions are such that the lock is unlocked, controller 195 operates the switch, i.e. triac 191, to control flow of electric current to heating element 130*b* based on water temperature and set points according to the algorithm discussed below, whereas when the lock is locked, controller 195 controls the triac to maintain the triac in an inactive state, e.g. regardless of water temperature.

Figure 8:
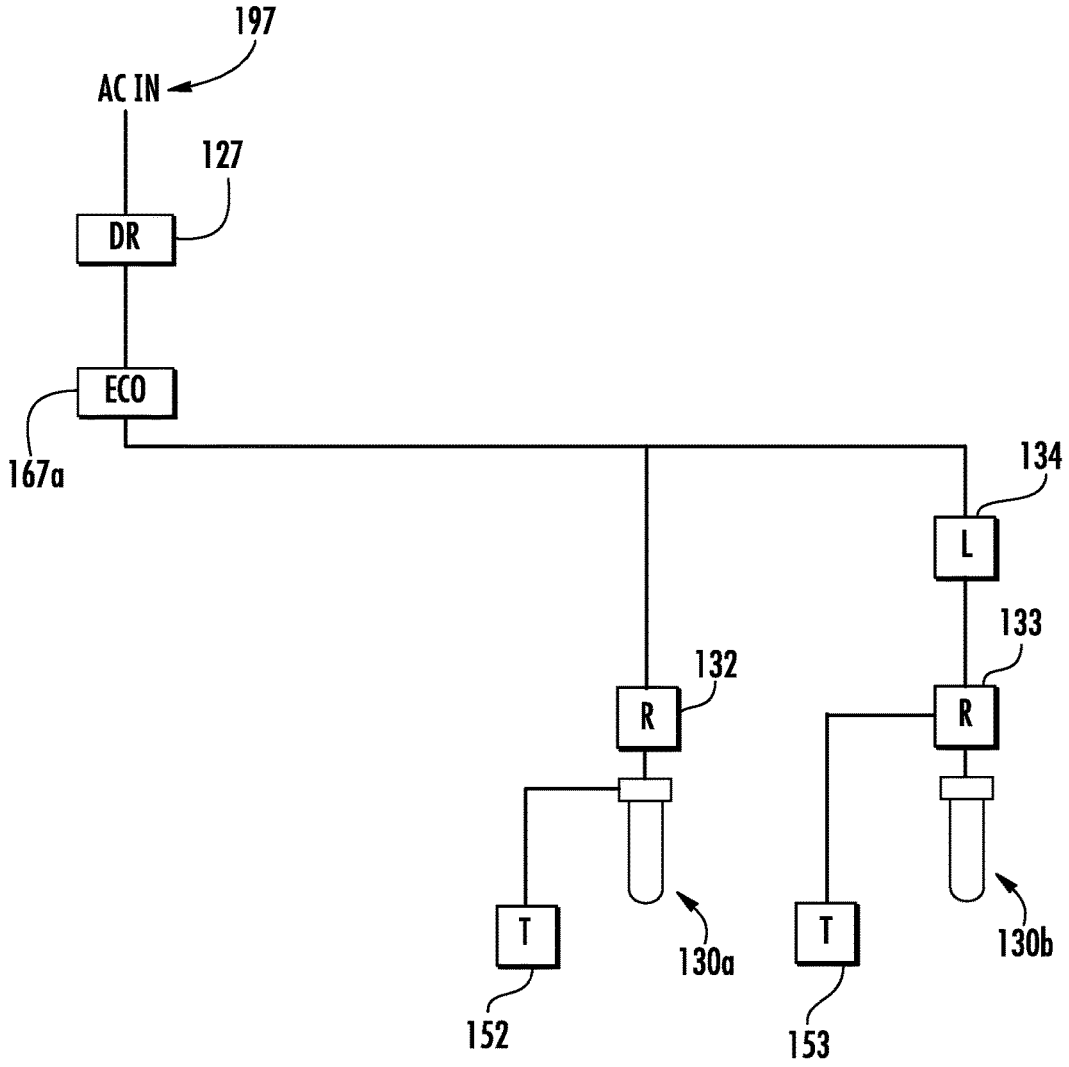
FIG. 8 is a schematic illustration of an alternate embodiment of a water heater in accordance with the present invention.

Referring now to FIG. 8, a schematic illustration of the circuitry of a water heater utilizing a mechanical lock and other controls is shown. In contrast to the previously discussed electronically controlled embodiments, the embodiment illustrated in FIG. 8 relies on electromechanical controls to control operation of the associated water heater. A key-activated activation lock 134 similar to the one discussed with regard to FIGS. 4 and 5 is utilized to enable/disable bottom heating element 130*b*. As well, rather than thermistors, top and bottom thermostats 152 and 153 are located on the outer surface of the water tank adjacent top and bottom heating elements 130*a* and 130*b*, respectively. Both top and bottom thermostats 152 and 153 include a bimetallic switch that is configured to open at a predetermined high temperature (i.e. the high set point temperature), and close at a predetermined low temperature (i.e. the low set point temperature). In turn, the top and bottom bimetallic switches control the operation of top and bottom relays 132 and 133, respectively, that are in the current paths between AC power source 197 and top and bottom heating elements 130*a* and 130*b*, respectively. If the bimetallic switches detect that water in the tank is at or below the lower set point, the bimetallic switches close, thereby closing the corresponding relays/switches in the electric current paths and providing electric current to the heating elements. This causes the corresponding heating elements to generate resistive heat, thereby increasing temperature of water in the tank. Note, top and bottom thermostats 152 and 153 operate independently of each other, meaning top and bottom heating elements 130*a* and 130*b* do as well. The bimetallic switches continue to sense the tank water's temperature as that temperature increases. When the switches detect that the temperature has reached the high set point, the switches open, thereby opening the corresponding circuit relays 132 and 133 and disconnecting the electric current source from the corresponding heating element. The bimetallic switches remain open as the tank water cools but close again when the now-cooler water reaches the low set point, and the cycle repeats.

As discussed above, activation lock 134 may be a key-activated pin tumbler lock, with the pin tumbler mechanically connected to a single pole switch that operates as described above with respect to FIG. 4. When the single pole switch is closed (its conductive state), AC electric current flows from source 197 to bottom heating element 130*b*. When activation lock 134 is in its as-shipped condition, the single pole switch is open (its non-conductive state), thereby preventing electric flow from AC power supply 197 to bottom heating element 130*b*. Once the water heater is installed and enrolled in a demand response program, the utility service representative (who has received the key from the water heater manufacturer) inserts the key into lock 134 and moves the lock from the closed to the open state.

It should be understood that the circuit configurations illustrated herein are for purposes of example only and not in limitation of the present invention. For example, an activation lock 134 may be placed operatively between both heating elements and the AC power source, so that the lock preempts use of both heating elements when in the locked, or open, state as delivered. Moreover, the lock may control one or more than one heating element in a water heater having more than two heating elements, so that one or more heating elements in the water heater are controlled by the lock while one or more heating elements in the same water heater are simultaneously not affected by the lock's position or state.

In both the electrical/software and the mechanical examples of the activation lock discussed herein, the activation lock defines (a) a locked state, in which the activation lock fixes the electrical circuit between the AC power source and the one or more heating elements controlled by the activation lock to a single state, i.e. the non-conducting state in the above-described examples, regardless of the operation of the control system that otherwise controls the application of electric current from the power source to the heating elements responsively to water temperature, and (b) an unlocked, or conductive, state, in which the control system can otherwise control the application of current from the power source to the heating elements responsively to water temperature. For example, in the locked state of controller 195 in the embodiments of FIGS. 4-7, controller 195 fixes the underlying switch controlled by the lock (i.e. the triac) in one state (i.e. non-conducting) regardless whether the control algorithm that controls the application of current to the heating element would otherwise control the triac to be conductive. If, however, controller 195 is in the other, i.e. unlocked, state, the controller will actuate and deactuate the triac according the temperature-responsive algorithm. Similarly, in the embodiment illustrated in FIG. 8 having a mechanical activation lock, when activation lock 134 is moved to the locked state, the single pole switch is fixed to an electrically open position. Thus, regardless of the operation of bimetallic switch 153, no current flows from power source 197 to lower heating element 130*b*. When activation lock 134 is in the other, locked or conducting, state, the electric current circuit is again responsive to the operation of bimetallic switch 153. Accordingly, the alternating states of the activation locks can be described as alternatingly (a) configuring the electric current circuit between the power source and the one or more heating elements so that the circuit is non-responsive to the controller that controls the circuit responsively to tank water temperature and (b) configuring the electric current circuit between the power source and the heating element so that the circuit is responsive to the controller that controls the circuit responsively to tank water temperature.

Figure 9:
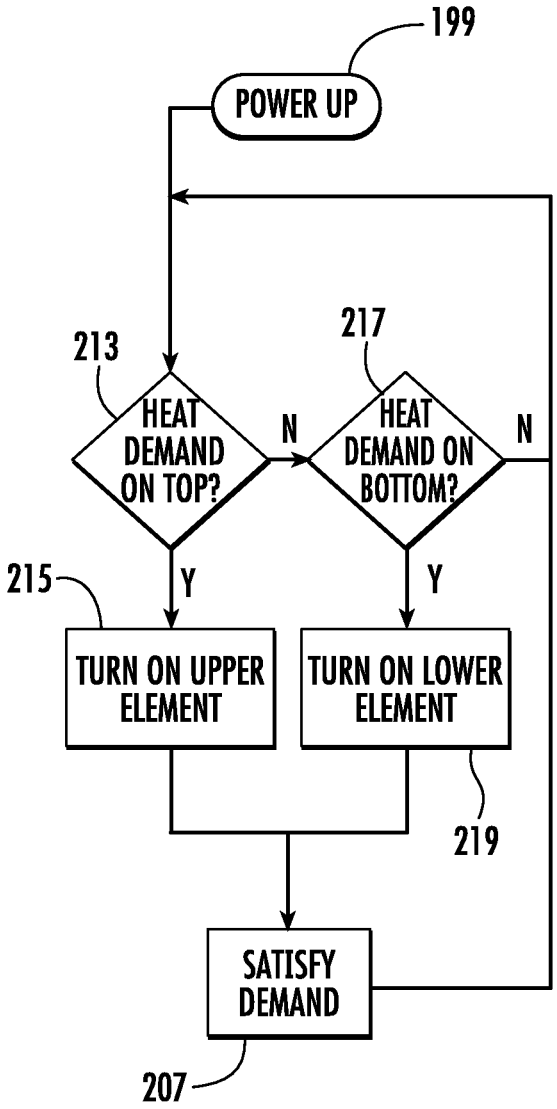
FIG. 9 is a flow diagram of operation of an embodiment of a water heater as in FIG. 1.
Figure 10:
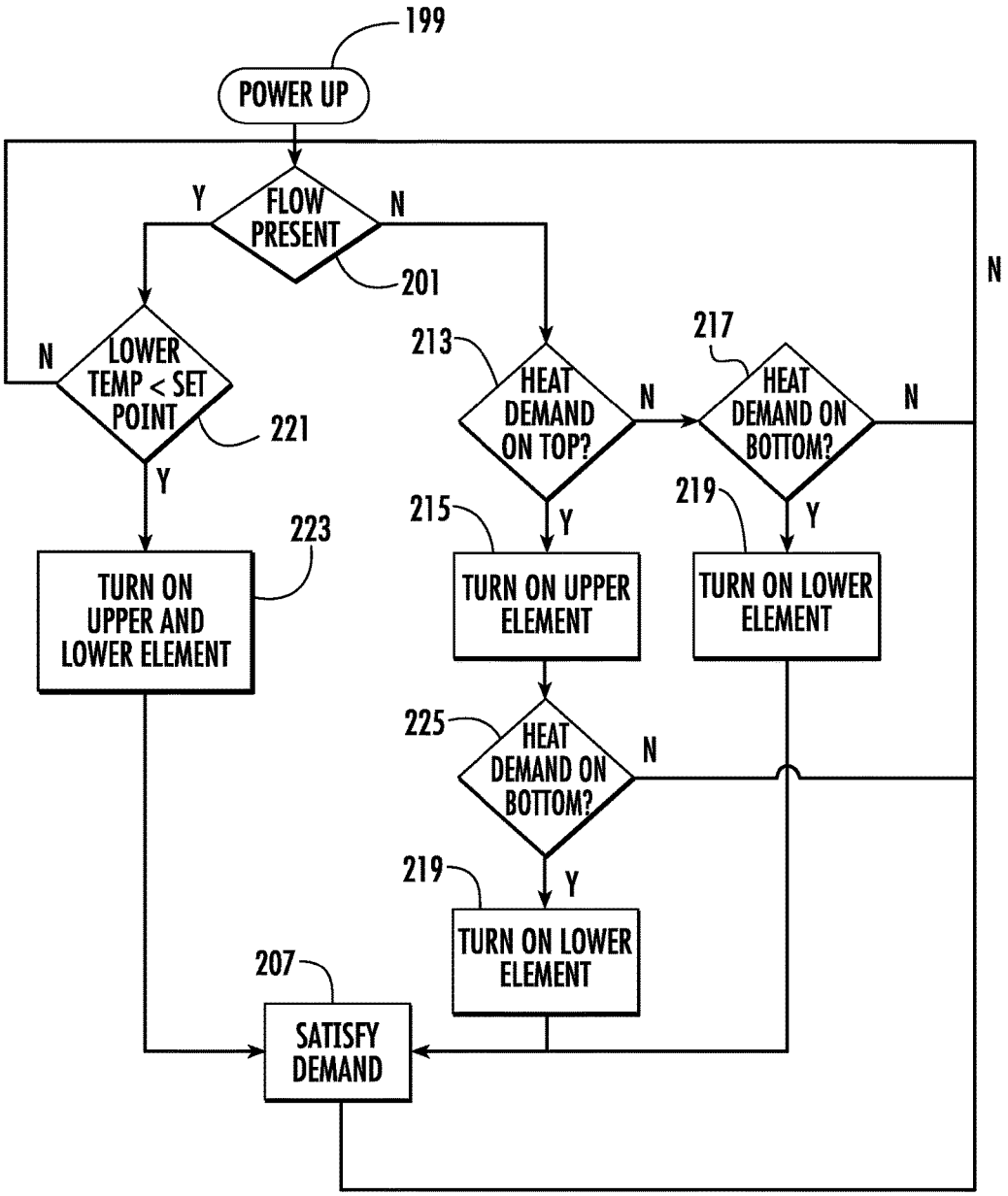
FIG. 10 is a flow diagram of operation of an embodiment of a water heater as in FIG. 1.

Operation of water heater 100 by a control system as in FIGS. 4-7 is illustrated at FIGS. 9 and 10. FIG. 9 illustrates the system's operation under a qualification that only one of the two resistance heating elements 130*a* and 130*b* can be actuated at the time. Accordingly, this is referred to herein as "non-simultaneous" operation of the water heater. FIG. 10 illustrates operation when both heating elements can be (but are not necessarily) operated simultaneously. Simultaneous operation, which may be preferred in applications where quick heating of water is desirable, draws a higher level of electric current than non-simultaneous operation, and non-simultaneous operation may be utilized where more appropriate for the electrical system with which the water heater is used, for example depending on circuit breaker levels.

Referring to FIGS. 4 and 9, at system power-up at 199, controller 195 checks, at 213 whether there is a demand for activation of top heating element 130*a*. To do this, controller 195 compares the output signal from temperature sensor 185, which is proximate water flowing out of fitting 112 and through an outlet pipe, to the water heater's low set point. The water heater's low and high set points are stored in memory associated with controller 195.

If the actual temperature for the water proximate top heating element 130*a*, as indicated by the signal from temperature sensor 165, is at or below the water heater's low set point, controller 195, at step 215, controls the operation of triac 189 to apply power to top resistive heating element 130*a* to bring the water flowing from hot water outlet fitting 112 to the desired temperature i.e., the high set point.

Upon providing power to the top heating element at step 215, the controller checks the output of temperature sensor 165 and compares the measured temperature to the high set point, at step 207. If the measured temperature is below the high set point, the controller maintains the electric current flow to the top heating element, thereby maintaining the heating element in an actuated state, and returns to step 199. The controller assumes heat demand at 213 and again checks the output of temperature sensor 165 at 207 against the upper set point. If that comparison shows that the water temperature at sensor 165 remains below the high set point, the controller returns to 199, and the loop continues. When, at 207, the water temperature as reflected by sensor 165 meets or exceeds the high set point, controller 195 removes the gate signal to triac 189, allowing the triac to close and thereby deactivating heating element 130*a*. Controller 195 then returns to step 199.

If, at step 213, there is no demand for heating at the top heating element as reflected by the signal from sensor 165, controller 195 checks the output of lower temperature sensor 169, at step 217. Also at step 217, however, controller 195 checks whether it has received the alphanumeric unlock code, as described above, from interface component 122 (FIGS. 4-7). If not (or regardless whether an unlock code has been received, the last-received code is a lock code), the controller returns to step 199, without actuating the lower heating element and regardless of the output of lower temperature sensor 169 and any comparison of the temperature corresponding thereto to the water heater's low set point temperature, and the cycle repeats.

If at 217 the alphanumeric unlock code has been received from interface component 122 (but no lock code thereafter received, i.e. if the last-received code is the unlock code), and if the temperature indicated by the output signal from sensor 169 is greater than the water heater's low set point temperature, no water heating is called for, and controller 195 returns to step 199. If, however, the temperature indicated by temperature sensor 169 is less than or equal to the water heater's low set point temperature, then, at step 219, controller 195 actuates triac 191 to allow electric current flow from electric current source 197 to bottom heating element 130*b*. As previously discussed, until activation lock 134 is turned from the locked position to the unlocked position, the associated single pole switch disposed between bottom triac 191 and bottom heating element 130*b* prevents the flow of current thereto. Controller 195 again checks the output of temperature sensor 169 at 207 to determine the temperature of water proximate bottom heating element 130*b*. If the measured temperature is less than the high set point, controller 195 maintains triac 191 in its conducting state and returns to step 199. The controller assumes no heat demand at 213, assumes heat demand at 217, maintains power to the bottom heating element at 219, and again checks the output of temperature sensor 169 at 207 against the high set point. If that comparison shows that the water temperature at sensor 169 remains below the high set point, the controller returns to 1999, and the loop continues. When, at step 207, the water temperature indicated by temperature sensor 169 is at or above the high set point, controller 195 closes triac 191, via control of its gate current, thereby deactivating bottom heating element 130*b*. Controller 195 then returns to step 199.

Referring to the simultaneous operation of the heating elements, as indicated at FIG. 10, and still with reference to FIG. 4, if, at 201, controller 195 detects flow from flow sensor 187, controller 195 may actuate both top and bottom heating elements 130*a* and 130*b*, through control of top and bottom triacs 189 and 191. More specifically, at step 221, controller 195 checks the output of temperature sensor 185 at the hot water outlet fitting or proximate hot water outlet pipe and compares the temperature indicated by the sensor's output to the water heater's low set point temperature. If that temperature is above the low set point, the controller does not activate the triacs and returns to step 201. If, however, the measured temperature is at or below the low set point, the controller sets triac 189 to its actuated state at 223. If the alphanumeric unlock code has not been received from interface component 122 or component 123 (or regardless whether an unlock code has been received, the last-received code is a lock code), the controller maintains triac 191 in an inactive state at 223, thereby precluding the application of electric current to the lower heating element. If the alphanumeric code has been received (but no lock code thereafter received, i.e. if the last-received code is the unlock code) from one of the interface components at 221, the controller sets triac 191 to its actuated state at 223. The controller checks the temperature signal from sensor 185 at 207 and compares the corresponding temperature to the high set point temperature. If the measured temperature from sensor 185 is below the high set point, the controller maintains both triacs in their state as determined at 221/223 and returns to 201. If flow remains present at 201, the controller assumes a heat demand at 221 and maintains triacs 189 and 191 in their existing states at 223, and again checks the temperature from sensor 185 against the high set point. If that temperature remains below the high set point, the controller returns to 201, and the loop continues. If, at 207, the output from sensor 185 indicates the output flow water temperature has reached or exceeded the high set point temperature, controller 195 deactivates both triacs, thereby deactivating both heating elements (the lower of which may already be inactive), and returns to step 201.

If, at step 201, controller 195 detects no flow from flow sensor 187, the controller executes the sequence of steps 213, 215, 217 and 219, as indicated in FIG. 10 and as described above with respect to FIG. 9. As a result, if there is no heating demand for the top heating element, the control system may still actuate the bottom heating element through steps 217 and 219, provided the alphanumeric unlock code is the last-received code from an interface component. Thus, there is a possible non-simultaneous actuation of the heating elements within the overall simultaneous operation of FIG. 10. A similar result occurs if the top heating element is activated at steps 213 and 215, in that the controller may or may not activate the bottom heating element simultaneously with the top heating element. More specifically, following step 215, controller 195, at step 225, checks the output of temperature sensor 169 and compares that temperature with the water heater's low set point. If the lower water temperature is above the low set point, such that there is no demand for heating by the bottom heating element, controller 195 maintains triac 191 in an off state and returns to step 201. Assuming that the flow sensor continues to show no flow present, controller 195 returns to step 213. Since steps 217 and 225 could result in the controller not checking for the high set point at 207, controller 195 at this step 213 assumes that water temperature is above the low set point but checks the output of temperature sensor 165 against the high set point. If the temperature is below the high set point, such that continued heating is needed, the top heating element is maintained in full operation at 215, and the controller checks the output of lower temperature sensor 169 against the low set point, at 225. If the temperature from sensor 165 is above the high set point at 213, the controller deactivates the top heating element and checks the output of lower temperature sensor 169 against the low set point, at 217. If the temperature from sensor 169 is above the low set point at 217, or if the temperature from sensor 165 is above the low set point at 225, the controller returns to 201, and the loop continues.

If, at 225 or 217, the temperature from lower temperature sensor 169 is below the lower set point, but controller 195 has not received the alphanumeric code from interface component 122, the controller also returns to step 201. However, if at 225, the temperature from sensor 169 is below the lower set point and the controller has received the alphanumeric code from the interface, the controller controls triac 191 to a fully closed state and maintains the closed state so that the bottom heating element is activated in a full condition, at 219. At 207, the controller checks the temperature signals of both sensors 165 and 169 against the high set point. If either sensor indicates a temperature above the high set point, the triac for that heating element is deactivated. If either sensor indicates a temperature below the high set point, the triac for that heating element is maintained active. Assume, then, that the bottom heating element is active, and the top heating element is inactive, when the controller returns to 201. At 213, the controller checks the output of temperature sensor 165 against the low set point and responds thereto as described above. Depending on the result of that comparison, the controller at 217 or 225 assumes a heating demand at the bottom heating element, maintains the bottom heating element's triac active at 219, and again checks the temperature signals from sensors 165 and 169 against the high set point at 207.

Assume, alternatively, at 201, that the bottom heating element is inactive, and the top heating element is active. At 213, the controller again assumes a water temperature above the low set point and checks the output of temperature sensor 165 against the high set point, as described above. Depending on the result of that comparison, the controller at 217 or 225 checks the output of temperature sensor 169 against the low set point, and the loop continues.

Assume a condition in which the controller activates the bottom heating element, or maintains the bottom heating element in an active state, via step 217. When the controller then moves to 207, the bottom heating element is active and the top heating element is inactive. Thus, at 207, the controller checks the output of lower temperature sensor 169 against the high set point. If the temperature is below the high set point, the controller maintains triac 191 in an active state and returns to step 201. If there remains no flow, the controller checks the output of upper temperature sensor 165 against the low set point at 213 and, depending on the comparison, activates triac 189 to activate the upper heating element at 215 and moves to 225, or maintains triac 189 in an inactive state and moves to 217. Upon either path, the controller assumes a heat demand for the bottom heating element, and the loop continues as discussed above.

If both outputs for temperature sensors 165 and 169 indicate temperatures at or above the high set point at 207, the controller deactivates both triacs 189 and 191 and returns to 201. If, during this process, the flow sensor switches from no-flow to flow at 201, the controller deactivates both triacs 189 and 191, and moves to step 221.

Accordingly, in the simultaneous operation description illustrated in FIG. 10, simultaneous operation of both heating elements is forced if water flow is detected at step 201 but is optional, depending on the respective actual water temperatures of the upper and lower portions of the tank, if no flow is present.

While one or more preferred embodiments of the invention are described above, it should be appreciated by those skilled in the art that various modifications and variations can be made in the present invention without departing from the scope and spirit thereof. For example, for the embodiments discussed with regard to FIGS. 4 through 8, top and bottom triacs 189 and 191 may be replaced by relays. Accordingly, it should be understood that the elements of one embodiment may be combined with another embodiment to create a still further embodiment. It is intended that the present invention cover such modifications and variations as come within the scope and spirit of the present disclosure, the appended claims, and their equivalents.

What is claimed is:

1. A water heater, comprising:

(a) a tank having a wall defining a volume therein for holding water;

(b) a first heating element extending through the wall and into the volume, the first heating element configured for connection to a power source and so that, when connected to the power source, a portion of the first heating element within the volume generates heat;

(c) a connector configured for connection to the power source, and a first electric circuit between the connector and the first heating element;

(d) a switch, wherein the switch is disposed in the first electric circuit and the first electric circuit is configured so that, if the switch is in a first state, the first electric circuit is in an electrically conductive state between the connector and the first heating element and, if the switch is in a second state, the first electric circuit is in an electrically non-conductive state between the connector and the first heating element; and (e) a controller comprising a processor, the controller in operative communication with the switch and responsive to a key so that actuation of the controller by the key transitions the switch between the first state and the second state, wherein the key is an alphanumeric code, and wherein the water heater further comprises an interface having an alphanumeric entry device, wherein the interface is in communication with the processor so that entry of the key via the alphanumeric entry device causes the interface to transmit the entered key to the processor.

2. The water heater as in claim 1, wherein the switch is a single pole switch, and the controller is a mechanical two-position lock.

3. The water heater as in claim 2, wherein the mechanical two-position lock is a pin tumbler lock, wherein the pin tumbler lock is in communication with the single pole switch so that actuation of the pin tumbler lock by a key between the two positions of the pin tumbler lock moves the single pole switch between the first state and the second state.

4. The water heater as in claim 1, wherein the switch is a triac, and wherein the processor is in communication with the triac so that the processor controls a gate signal to the triac.

5. The water heater as in claim 1, comprising a computer readable medium containing program instructions executable by the processor to cause the processor, upon receipt of the key from the interface, to control the switch to the first state.

6. The water heater as in claim 1, comprising a second heating element extending through the wall and into the volume, the second heating element configured for connection to the power source and so that, when connected to the power source, a portion of the second heating element within the volume generates heat.

7. The water heater as in claim 6, wherein the actuation of the controller by the key does not affect delivery of electric current from the power source to the second heating element.

8. A water heater, comprising:

(a) a tank having a wall defining a volume therein for holding water;

(b) a first heating element extending through the wall and into the volume, the first heating element configured for connection to a power source and so that, when connected to the power source, a portion of the first heating element within the volume generates heat;

(c) a second heating element extending through the wall and into the volume, the second heating element configured for connection to the power source and so that, when connected to the power source, a portion of the second heating element within the volume generates heat;

(d) a connector configured for connection to the power source, a first electric circuit between the connector and the first heating element, and a second electric circuit between the connector and the second heating element;

(e) a switch, wherein the switch is disposed in the first electric circuit and the first electric circuit is configured so that, if the switch is in a first state, the first electric circuit is in an electrically conductive state between the connector and the first heating element via the switch and, if the switch is in a second state, the first electric circuit is in an electrically non-conductive state between the connector and the first heating element; and (f) a controller in operative communication with the switch and responsive to a key so that actuation of the controller by the key transitions the switch between the first state and the second state, wherein the actuation of the controller by the key does not affect delivery of electric current from the power source to the second heating element.

9. The water heater as in claim 8, wherein the switch is a single pole switch, and the controller is a mechanical two-position lock.

10. The water heater as in claim 9, wherein the mechanical two-position lock is a pin tumbler lock, wherein the pin tumbler lock is in communication with the single pole switch so that actuation of the pin tumbler lock by a key between the two positions of the pin tumbler lock moves the single pole switch between the first state and the second state.

11. The water heater as in claim 8, wherein the controller comprises a processor in electrical communication with the switch.

12. The water heater as in claim 11, wherein the switch is a triac, and wherein the processor is in communication with the triac so that the processor controls a gate signal to the triac.

13. The water heater as in claim 11, wherein the key is an alphanumeric code, and wherein the water heater further comprises an interface having an alphanumeric entry device, wherein the interface is in communication with the processor so that entry of the key via the alphanumeric entry device causes the interface to transmit the entered key to the processor.

14. The water heater as in claim 11, comprising a computer readable medium containing program instructions executable by the processor to cause the processor, upon receipt of the key from the interface, to control the switch to the first state.

15. A water heater, comprising:

(a) a water tank defining a volume;

(b) a plurality of electric heating elements extending into the volume of the water tank;

(c) a plurality of circuit loops, each circuit loop including a respective electric heating element of the plurality of electric heating elements so that when each circuit loop is complete between a power source and its respective heating element, each circuit loop causes electric current flow through the respective electric heating element to thereby generate heat in the water tank, and also including a respective thermostat that is both disposed adjacent the water tank so that the respective thermostat detects temperature of water in the water tank, and that is configured to complete and disable a respective said circuit loop in response to a detected temperature; and (d) a circuit breaker disposed in at least one of the plurality of circuit loops, the circuit breaker defining a conductive state in which the circuit breaker conducts electricity through the at least one circuit loop and a non-conductive state in which the circuit breaker disables electric current flow through the at least one circuit loop and defining an activation lock so that engagement of a key with the activation lock enables conversion of the circuit breaker between the conductive and non-conductive states, wherein the engagement of the activation lock by the key does not affect delivery of electric current flow from the power source through a remainder of the plurality of circuit loops.

* * * * *